US011866656B2

(12) United States Patent
Lopez-Garcia et al.

(10) Patent No.: US 11,866,656 B2
(45) **Date of Patent: *Jan. 9, 2024**

(54) METHOD FOR PRODUCING A PETROL WITH LOW SULPHUR AND MERCAPTAN CONTENT

(71) Applicant: IFP Energies nouvelles, Rueil-Malmaison (FR)

(72) Inventors: Clementina Lopez-Garcia, Rueil-Malmaison (FR); Philibert Leflaive, Rueil-Malmaison (FR)

(73) Assignee: IFP ENERGIES NOUVLLES, Rueil-Malmaison (FR)

( * ) Notice: Subject to any disclaimer, the term of this patent is extended or adjusted under 35 U.S.C. 154(b) by 76 days.

This patent is subject to a terminal disclaimer.

(21) Appl. No.: 17/629,067

(22) PCT Filed: Jul. 6, 2020

(86) PCT No.: PCT/EP2020/069032

§ 371 (c)(1),
(2) Date: Jan. 21, 2022

(87) PCT Pub. No.: WO2021/013526

PCT Pub. Date: Jan. 28, 2021

(65) Prior Publication Data

US 2022/0275291 A1 Sep. 1, 2022

(30) Foreign Application Priority Data

Jul. 23, 2019 (FR) ..... 1908338

(51) Int. Cl.
*C10G 65/04* (2006.01)
*C10G 65/06* (2006.01)
(Continued)

(52) U.S. Cl.
CPC ..... *C10G 65/04* (2013.01); *C10G 45/32* (2013.01); *C10G 45/38* (2013.01); *C10G 65/06* (2013.01);
(Continued)

(58) Field of Classification Search
CPC ..... C10G 45/06; C10G 45/08; C10G 65/04; C10G 65/06; C10G 2300/4006
See application file for complete search history.

(56) References Cited

U.S. PATENT DOCUMENTS

2002/0153280 A1 10/2002 Didillon et al.
2014/0374315 A1* 12/2014 Gornay ..... C10G 45/04 208/189

FOREIGN PATENT DOCUMENTS

EP 1077247 A1 2/2001

OTHER PUBLICATIONS

International Search Report for PCT/EP2020/069032 dated Jul. 27, 2020.

* cited by examiner

*Primary Examiner* — Renee Robinson
(74) *Attorney, Agent, or Firm* — Millen, White, Zelano & Branigan, P.C.; Brion P. Heaney

(57) ABSTRACT

The present application relates to a method for treating a petrol containing sulphur compounds, olefins and diolefins, the method comprising the following steps: a) a step of hydrodesulphurisation in the presence of a catalyst comprising an oxide support and an active phase comprising a group VIB metal and a group VIII metal from, b) a step of hydrodesulphurising at least one portion of the effluent from step a) at a higher hydrogen flow rate/feed ratio and a temperature higher than those of step a) without removing the $H_2S$ formed in the presence of a catalyst comprising an
(Continued)

oxide support and an active phase consisting of at least one group VIII metal, c) a step of separating the $H_2S$ formed in the effluent from step b).

21 Claims, 2 Drawing Sheets

(51) Int. Cl.
*C10G 45/32* (2006.01)
*C10G 45/38* (2006.01)
*C10G 11/02* (2006.01)

(52) U.S. Cl.
CPC ..... *C10G 11/02* (2013.01); *C10G 2300/104* (2013.01); *C10G 2300/1044* (2013.01); *C10G 2300/202* (2013.01); *C10G 2300/4006* (2013.01)

METHOD FOR PRODUCING A PETROL WITH LOW SULPHUR AND MERCAPTAN CONTENT

TECHNICAL FIELD

The present invention relates to a process for the production of gasoline having a low content of sulfur and of mercaptans.

STATE OF THE ART

The production of gasolines meeting new environmental standards requires that their sulfur content be significantly decreased.

It is furthermore known that conversion gasolines, and more particularly those originating from catalytic cracking, which can represent from 30% to 50% of the gasoline pool, have high contents of monoolefins and of sulfur.

The sulfur present in gasolines is for this reason attributable, to close to 90%, to the gasolines resulting from catalytic cracking processes, which will be called FCC (Fluid Catalytic Cracking) gasolines subsequently. FCC gasolines thus constitute the preferred feedstock for the process of the present invention.

Among the possible routes for producing fuels having a low sulfur content, that which has been very widely adopted consists in specifically treating sulfur-rich gasoline bases by catalytic hydrodesulfurization processes in the presence of hydrogen. Conventional processes desulfurize gasolines in a nonselective manner by hydrogenating a large part of the monoolefins, which causes a high loss in octane number and a high consumption of hydrogen. The most recent processes, such as the Prime G+ (trademark) process, make it possible to desulfurize cracked gasolines rich in olefins, while limiting the hydrogenation of the monoolefins and consequently the loss of octane and the high hydrogen consumption which results therefrom. Such processes are, for example, described in the patent applications EP 1 077 247 and EP1 174 485.

The residual sulfur compounds generally present in desulfurized gasoline can be separated into two distinct families: the unconverted refractory sulfur compounds present in the feedstock, on the one hand, and the sulfur compounds formed in the reactor by secondary "recombination" reactions. Among this last family of sulfur compounds, the predominant compounds are the mercaptans resulting from the addition of $H_2S$ formed in the reactor to the monoolefins present in the feedstock.

Mercaptans of chemical formula R—SH, where R is an alkyl group, are also called recombinant mercaptans. Their formation or their decomposition obeys the thermodynamic equilibrium of the reaction between monoolefins and hydrogen sulfide to form recombinant mercaptans. An example is illustrated according to the following reaction:

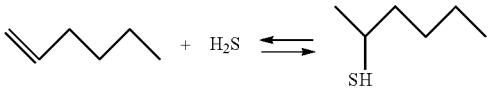

Sulfur in the form of recombinant mercaptans generally represents between 20% and 80% by weight of the residual sulfur in desulfurized gasolines.

The formation of recombinant mercaptans is in particular described in the patent U.S. Pat. No. 6,231,754 and the patent application WO01/40409, which teach various combinations of operating conditions and of catalysts making it possible to limit the formation of recombinant mercaptans.

Other solutions to the problem of the formation of recombinant mercaptans are based on a treatment of partially desulfurized gasolines in order to extract therefrom said recombinant mercaptans. Some of these solutions are described in the patent applications WO02/28988 or WO01/79391.

Still other solutions are described in the literature for desulfurizing cracked gasolines using a combination of stages of hydrodesulfurization and of removal of the recombinant mercaptans by reaction to give thioethers or disulfides (also called sweetening) (see, for example, U.S. Pat. Nos. 7,799,210, 6,960,291, 2007114156, EP 2 861 094).

The document WO2018/096063 describes a process for the production of hydrocarbons having a low content of sulfur and of mercaptans using a high gas flow rate/feedstock ratio.

To obtain a gasoline having a very low sulfur content, typically at a content of less than 10 ppm by weight, thus requires the removal of at least a part of the recombinant mercaptans. Virtually all countries have a very low specification for mercaptans in fuels (typically less than 10 ppm sulfur resulting from RSHs (measurement of content of mercaptans by potentiometry, ASTM D3227 method).

Other countries have adopted a "Doctor Test" measurement to quantify the mercaptans with a negative specification to be observed (ASTM D4952 method).

Thus, in some cases, it appears that the most restrictive specification, because the most difficult to achieve without harming the octane number, is the specification for mercaptans and not that of the total sulfur.

An aim of the present invention is to provide a process for the treatment of a gasoline containing sulfur, a part of which is in the form of mercaptans, which makes it possible to reduce the content of mercaptans of said hydrocarbon fraction while limiting as much as possible the loss of octane.

When gasoline is treated by a sequence of two reactors without removal of the $H_2S$ between the two stages, as described in the document EP 1 077 247, the first stage, also called the selective HDS stage, generally has the aim of carrying out a deep desulfurization of the gasoline with a minimum of saturation of the olefins (and no aromatic loss), resulting in a maximum octane retention. The catalyst employed is generally a catalyst of CoMo type. During this stage, new sulfur compounds are formed by recombination of the $H_2S$ resulting from the desulfurization and olefins: recombinant mercaptans.

The second stage generally has the role of minimizing the amount of recombinant mercaptans. For this, the gasoline is then treated in a hydrodesulfurization reactor, also called finishing reactor, with a catalyst generally based on nickel which exhibits virtually no olefin hydrogenation activity and is capable of reducing the amount of recombinant mercaptans. The temperature is generally higher in the finishing reactor in order to thermodynamically promote the removal of the mercaptans. In practice, an oven is thus placed between the two reactors in order to be able to raise the temperature of the second reactor to a temperature greater than that of the first.

In the prior art, for a sequence of two reactors without removal of the $H_2S$ between the two stages, the hydrogen used in the two stages is injected in full into the selective HDS reactor, the amount of hydrogen entering the finishing reactor being subject and equal to the amount injected into the first reactor decreased by the hydrogen consumed in this first reactor.

When a very active catalyst is placed in the first reactor, the operating temperature is generally not very high in order to sufficiently desulfurize the gasoline without causing a strong hydrogenation of the olefins. However, a reactor which is too cold can cause several problems, in particular a two-phase and no longer 100% gaseous flow, potentially inducing hydrodynamic problems or even the impossibility of reaching a sufficiently high temperature in the finishing reactor to carry out a satisfactory conversion of the recombinant mercaptans, the heating power of the intermediate oven being limited.

A known solution of the prior art is then to simultaneously lower the ratio of the hydrogen flow rate to the flow rate of feedstock to be treated, also subsequently called $H_2$/HC ratio, and to increase the temperature of the first reactor. The negative influence of the fall in the $H_2$/HC ratio on the reactions for hydrodesulfurization and for hydrogenation of the olefins is compensated for by the increase in the temperature. The increase in the temperature in the first reactor then makes it possible to adjust the temperature of the finishing reactor to a higher value.

However, the induced fall in the $H_2$/HC ratio in the finishing reactor has a negative effect on the thermodynamics of the reaction for removal of the recombinant mercaptans, the partial pressures of $H_2S$ and of olefins being higher.

SUMMARY OF THE INVENTION

An object of the present invention is to overcome the disadvantages of the prior art by using, in a sequence of two reactors without removal of the $H_2S$ between the two stages, a higher $H_2$/HC ratio in the finishing stage than in the selective HDS stage. This is achieved by an injection of (fresh or recycled) hydrogen upstream of the finishing reactor. The use of a higher $H_2$/HC ratio in the finishing reactor makes it possible in particular to maintain a high temperature in the first reactor (and thus also in the finishing reactor), while lowering the partial pressures of $H_2S$ and of olefins in the finishing reactor in order to optimize the conversion of the recombinant mercaptans. This is because the increase in the $H_2$/HC ratio in the finishing stage makes it possible, by dilution, to reduce the partial pressure of the $H_2S$ (pp$H_2S$) formed by hydrodesulfurization during the selective HDS stage. This fall in the partial pressure of the $H_2S$ promotes the removal of the recombinant mercaptans formed by the "recombination" reaction between the olefins and the $H_2S$ (thermodynamic equilibrium).

More particularly, a subject matter of the invention is a process for the treatment of a gasoline containing sulfur compounds, olefins and diolefins, the process comprising at least the following stages:

a) the gasoline, hydrogen and a hydrodesulfurization catalyst comprising an oxide support and an active phase comprising a metal from group VIb and a metal from group VIII are brought into contact in at least one reactor at a temperature of between 210 and 320° C., at a pressure of between 1 and 4 MPa, with a space velocity of between 1 and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$, so as to convert at least a part of the sulfur compounds into $H_2S$, b) at least a part of the effluent resulting from stage a) without removal of the $H_2S$ formed, hydrogen and a hydrodesulfurization catalyst comprising an oxide support and an active phase consisting of at least one metal from group VIII are brought into contact in at least one reactor at a temperature of between 280 and 400° C., at a pressure of between 0.5 and 5 MPa, with a space velocity of between 1 and 10 $h^{-1}$ and a ratio of the hydrogen flow rate to the flow rate of feedstock to be treated which is greater than that of stage a), said temperature of stage b) being higher than the temperature of stage a), c) a stage of separation of the $H_2S$ formed and present in the effluent resulting from stage b) is carried out.

Another advantage of the process according to the invention comes from the fact that it can easily be installed on existing units (remodeling or revamping).

According to an alternative form, the ratio of the ratio of the hydrogen flow rate to the flow rate of feedstock to be treated at the inlet of the reactor of stage b)/ratio of the hydrogen flow rate to the flow rate of feedstock to be treated at the inlet of the reactor of stage a) is greater than or equal to 1.05.

According to an alternative form, the ratio is between 1.1 and 4.

According to an alternative form, fresh hydrogen is injected in stage c).

According to an alternative form, the temperature of stage b) is greater by at least 5° C. than the temperature of stage a).

According to an alternative form, the catalyst of stage a) comprises alumina and an active phase comprising cobalt, molybdenum and optionally phosphorus, said catalyst containing a content by weight, with respect to the total weight of catalyst, of cobalt oxide, in CoO form, of between 0.1% and 10%, a content by weight, with respect to the total weight of catalyst, of molybdenum oxide, in $MoO_3$ form, of between 1% and 20%, a cobalt/molybdenum molar ratio of between 0.1 and 0.8 and a content by weight, with respect to the total weight of catalyst, of phosphorus oxide in $P_2O_5$ form of between 0.3% and 10%, when phosphorus is present, said catalyst having a specific surface between 30 and 180 $m^2/g$.

According to an alternative form, the catalyst of stage b) consists of alumina and of nickel, said catalyst containing a content by weight, with respect to the total weight of catalyst, of nickel oxide, in NiO form, of between 5% and 20%, said catalyst having a specific surface between 30 and 180 $m^2/g$.

According to an alternative form, the stage of separation c) of the effluent from stage b) is carried out in a debutanizer or a stripping section.

According to an alternative form, before stage a), a stage of distillation of the gasoline is carried out so as to fractionate said gasoline into at least two light and heavy gasoline cuts, and the heavy gasoline cut is treated in stages a), b) and c).

According to an alternative form, before stage a) and before any optional distillation stage, the gasoline is brought into contact with hydrogen and a selective hydrogenation catalyst in order to selectively hydrogenate the diolefins contained in said gasoline to give olefins.

According to an alternative form, the gasoline is a catalytic cracked gasoline.

According to an alternative form, stage b) is carried out in at least two reactors in parallel.

According to this alternative form, the $H_2$/HC ratio of stage b) is the same for each reactor in parallel.

According to another alternative form, during a stage b') carried out in parallel of stage b), another part of the effluent resulting from stage a) without removal of the $H_2S$ formed, hydrogen and a hydrodesulfurization catalyst comprising an oxide support and an active phase consisting of at least one metal from group VIII are brought into contact in at least one reactor at a temperature of between 280 and 400° C., at a pressure of between 0.5 and 5 MPa, with a space velocity of between 1 and 10 $h^{-1}$ and a ratio of the hydrogen flow rate, expressed in standard $m^3$ per hour, to the flow rate of feedstock to be treated, expressed in $m^3$ per hour at standard conditions, of between 100 and 600 $Sm^3/m^3$, said temperature of stage b') being higher than the temperature of stage a).

Subsequently, the groups of chemical elements are given according to the CAS classification (CRC Handbook of Chemistry and Physics, published by CRC Press, editor-in-chief D. R. Lide, 81$^{st}$ edition, 2000-2001). For example, group VIII according to the CAS classification corresponds to the metals of Columns 8, 9 and 10 according to the new IUPAC classification.

The content of metals is measured by X-ray fluorescence.

DETAILED DESCRIPTION OF THE INVENTION

Description of the Feedstock

Figure 1:
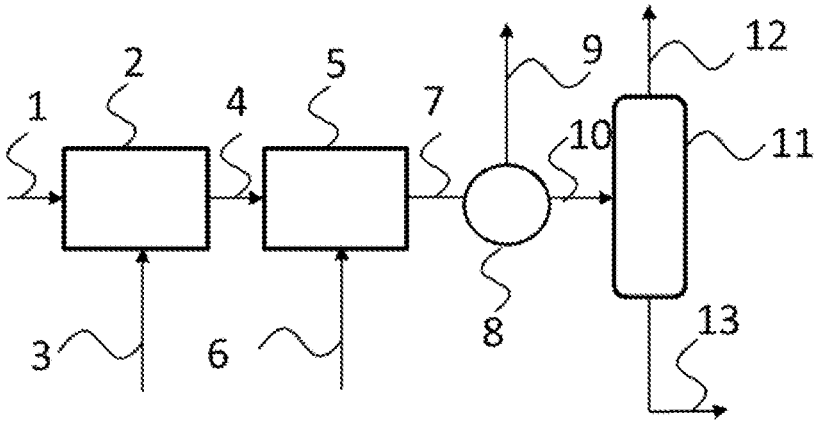
FIG. 1 illustrates an embodiment according to the invention.

The process according to the invention makes it possible to treat any type of gasoline cut containing sulfur compounds and olefins, such as, for example, a cut resulting from a coking, visbreaking, steam cracking or catalytic cracking (FCC, Fluid Catalytic Cracking) unit. This gasoline can optionally be composed of a significant fraction of gasoline originating from other production processes, such as atmospheric distillation (gasoline resulting from a direct distillation (or straight run gasoline)), or from conversion processes (coking or steam cracked gasoline). Said feedstock preferably consists of a gasoline cut resulting from a catalytic cracking unit.

The feedstock is a gasoline cut containing sulfur compounds and olefins, the boiling point range of which typically extends from the boiling points of the hydrocarbons having 2 or 3 carbon atoms (C2 or C3) up to 260° C., preferably from the boiling points of the hydrocarbons having 2 or 3 carbon atoms (C2 or C3) up to 220° C., more preferably from the boiling points of the hydrocarbons having 5 carbon atoms up to 220° C. The process according to the invention can also treat feedstocks having lower end points than those mentioned above, such as, for example, a C5-180° C. cut.

The sulfur content of the gasoline cuts produced by catalytic cracking (FCC) depends on the sulfur content of the feedstock treated by the FCC, on the presence or not of a pretreatment of the feedstock of the FCC, and also on the end point of the cut. Generally, the sulfur contents of the whole of a gasoline cut, in particular those originating from the FCC, are greater than 100 ppm by weight and most of the time greater than 500 ppm by weight. For gasolines having end points of greater than 200° C., the sulfur contents are often greater than 1000 ppm by weight; they can even, in certain cases, reach values of the order of 4000 to 5000 ppm by weight.

In addition, the gasolines resulting from catalytic cracking (FCC) units contain, on average, between 0.5% and 5% by weight of diolefins, between 20% and 50% by weight of olefins and between 10 ppm and 0.5% by weight of sulfur, generally less than 300 ppm of which of mercaptans.

Description of the Hydrodesulfurization Stage a)

The hydrodesulfurization stage a) is implemented in order to reduce the sulfur content of the gasoline to be treated by converting the sulfur compounds into $H_2S$, which is subsequently removed in stage c). Its implementation is particularly necessary when the feedstock to be desulfurized contains more than 100 ppm by weight of sulfur and more generally more than 50 ppm by weight of sulfur.

The hydrodesulfurization stage a) consists in bringing the gasoline to be treated into contact with hydrogen, in one or more hydrodesulfurization reactors, containing one or more catalysts suitable for carrying out the hydrodesulfurization.

According to a preferred embodiment of the invention, stage a) is implemented with the aim of carrying out a hydrodesulfurization selectively, that is to say with a degree of hydrogenation of the monoolefins of less than 80%, preferably of less than 70% and very preferably of less than 60%.

The temperature is generally between 210 and 320° C. and preferably between 220 and 290° C. The temperature employed must be sufficient to maintain the gasoline to be treated in the vapor phase in the reactor. In the case where the hydrodesulfurization stage a) is carried out in several reactors in series, the temperature of each reactor is generally greater by at least 5° C., preferably by at least 10° C. and very preferably by at least 30° C. than the temperature of the reactor which precedes it.

The operating pressure of this stage is generally between 1 and 4 MPa and preferably between 1.5 and 3 MPa.

The amount of catalyst employed in each reactor is generally such that the ratio of the flow rate of gasoline to be treated, expressed in $m^3$ per hour at standard conditions, per $m^3$ of catalyst (also called space velocity) is between 1 and 10 $h^{-1}$ and preferably between 2 and 8 $h^{-1}$.

The hydrogen flow rate is generally such that the ratio of the hydrogen flow rate, expressed in standard $m^3$ per hour ($Sm^3/h$), to the flow rate of feedstock to be treated, expressed in $m^3$ per hour at standard conditions (15° C., 0.1 MPa), is between 100 and 600 $Sm^3/m^3$, preferably between 200 and 500 $Sm^3/m^3$. Standard $m^3$ is understood to mean the amount of gas in a volume of 1 $m^3$ at 0° C. and 0.1 MPa.

The hydrogen required for this stage can be fresh hydrogen or recycled hydrogen, preferably freed from $H_2S$, or a mixture of fresh hydrogen and of recycled hydrogen. Preferably, fresh hydrogen will be used.

The degree of desulfurization of stage a), which depends on the sulfur content of the feedstock to be treated, is generally greater than 50% and preferably greater than 70%, so that the product resulting from stage a) contains less than 100 ppm by weight of sulfur and preferably less than 50 ppm by weight of sulfur.

The catalyst used in stage a) must exhibit a good selectivity with regard to the hydrodesulfurization reactions, in comparison with the reaction for the hydrogenation of olefins.

The hydrodesulfurization catalyst of stage a) comprises an oxide support and an active phase comprising a metal from group VIb and a metal from group VIII and optionally phosphorus and/or an organic compound as described below.

The metal from group VIb present in the active phase of the catalyst is preferentially chosen from molybdenum and tungsten. The metal from group VIII present in the active phase of the catalyst is preferentially chosen from cobalt, nickel and the mixture of these two elements. The active phase of the catalyst is preferably chosen from the group formed by the combination of the elements nickel-molybdenum, cobalt-molybdenum and nickel-cobalt-molybdenum and very preferably the active phase consists of cobalt and molybdenum.

The content of metal from group VIII is between 0.1% and 10% by weight of oxide of the metal from group VIII, with respect to the total weight of the catalyst, preferably of between 0.6% and 8% by weight, preferably of between 2% and 7% by weight, very preferably of between 2% and 6% by weight and more preferably still of between 2.5% and 6% by weight.

The content of metal from group VIb is between 1% and 20% by weight of oxide of the metal from group VIb, with respect to the total weight of the catalyst, preferably of between 2% and 18% by weight, very preferably of between 3% and 16% by weight.

The metal from group VIII to metal from group VIb molar ratio of the catalyst is generally between 0.1 and 0.8, preferably between 0.2 and 0.6.

In addition, the catalyst exhibits a density of metal from group VIb, expressed as number of atoms of said metal per unit area of the catalyst, which is between 0.5 and 30 atoms of metal from group VIb per $nm^2$ of catalyst, preferably between 2 and 25, more preferably still between 3 and 15. The density of metal from group VIb, expressed as number of atoms of metal from group VIb per unit area of the catalyst (number of atoms of metal from group VIb per $nm^2$ of catalyst), is calculated, for example, from the following relationship:

$$d\,(\text{metal from group } VIb) = \frac{(X \times N_A)}{(100 \times 10^{18} \times S \times M_M)}$$

with:

X=% by weight of metal from group VIb;

$N_A$=Avogadro's number, equal to $6.022\times10^{23}$;

S=Specific surface of the catalyst ($m^2/g$), measured according to the standard ASTM D3663;

$M_M$=Molar mass of the metal from group VIb (for example 95.94 g/mol for molybdenum).

For example, if the catalyst contains 20% by weight of molybdenum oxide $MoO_3$ (i.e. 13.33% by weight of Mo) and has a specific surface of 100 $m^2/g$, the density d(Mo) is equal to:

$$d(Mo) = \frac{(13.33 \times N_A)}{(100 \times 10^{18} \times 100 \times 96)} = 8.4 \text{ atoms of } Mo/\text{nm}^2 \text{ of catalyst}$$

Optionally, the catalyst can additionally exhibit a phosphorus content generally of between 0.3% and 10% by weight of $P_2O_5$, with respect to the total weight of catalyst, preferably between 0.5% and 5% by weight, very preferably between 1% and 3% by weight. For example, the phosphorus present in the catalyst is combined with the metal from group VIb and optionally also with the metal from group VIII in the form of heteropolyanions.

Furthermore, the phosphorus/(metal from group VIb) molar ratio is generally between 0.1 and 0.7, preferably between 0.2 and 0.6, when phosphorus is present.

Preferably, the catalyst is characterized by a specific surface of between 5 and 400 $m^2/g$, preferably of between 10 and 250 $m^2/g$, preferably of between 20 and 200 $m^2/g$, very preferably of between 30 and 180 $m^2/g$. The specific surface is determined in the present invention by the BET method according to the standard ASTM D3663, as described in the work by Rouquerol F., Rouquerol J. and Singh K., *Adsorption by Powders & Porous Solids: Principle, Methodology and Applications*, Academic Press, 1999, for example by means of an Autopore III™ model device of the Micromeritics™ brand.

The total pore volume of the catalyst is generally between 0.4 $cm^3/g$ and 1.3 $cm^3/g$, preferably between 0.6 $cm^3/g$ and 1.1 $cm^3/g$. The total pore volume is measured by mercury porosimetry according to the standard ASTM D4284 with a wetting angle of 140°, as described in the same work.

The tapped bulk density (TBD) of the catalyst is generally between 0.4 and 0.7 g/ml, preferably between 0.45 and 0.69 g/ml. The TBD measurement consists in introducing the catalyst into a measuring cylinder, the volume of which has been determined beforehand, and then, by vibration, in tapping it until a constant volume is obtained. The bulk density of the tapped product is calculated by comparing the weight introduced and the volume occupied after tapping.

Advantageously, the hydrodesulfurization catalyst, before sulfidation, exhibits a mean pore diameter of greater than 20 nm, preferably of greater than 25 nm, indeed even 30 nm and often of between 20 and 140 nm, preferably between 20 and 100 nm, and very preferentially between 25 and 80 nm. The pore diameter is measured by mercury porosimetry according to the standard ASTM D4284 with a wetting angle of 1400.

The catalyst can be in the form of cylindrical or multilobe (trilobe, quadrilobe, and the like) extrudates with a small diameter, or of spheres.

The oxide support of the catalyst is usually a porous solid chosen from the group consisting of: aluminas, silica, silica-aluminas and also titanium or magnesium oxides, used alone or as a mixture with alumina or silica-alumina. It is preferably chosen from the group consisting of silica, the family of the transition aluminas and silica-aluminas; very preferably, the oxide support is constituted essentially of alumina, that is to say that it comprises at least 51% by weight, preferably at least 60% by weight, very preferably at least 80% by weight, indeed even at least 90% by weight, of alumina. It preferably consists solely of alumina. Preferably, the oxide support of the catalyst is a "high temperature" alumina, that is to say which contains theta-, delta-, kappa- or alpha-phase aluminas, alone or as a mixture, and an amount of less than 20% of gamma-, chi- or eta-phase alumina.

The catalyst can also additionally comprise at least one organic compound containing oxygen and/or nitrogen and/or sulfur before sulfidation. Such additives are described subsequently.

A very preferred embodiment of the invention corresponds to the use, for stage a), of a catalyst comprising alumina and an active phase comprising cobalt, molybdenum and optionally phosphorus, said catalyst containing a content by weight, with respect to the total weight of catalyst, of cobalt oxide, in CoO form, of between 0.1% and 10%, a content by weight, with respect to the total weight of catalyst, of molybdenum oxide, in $MoO_3$ form, of between 1% and 20%, a cobalt/molybdenum molar ratio of between 0.1 and 0.8 and a content by weight, with respect to the total weight of catalyst, of phosphorus oxide in $P_2O_5$ form of between 0.3% and 10%, when phosphorus is present, said catalyst having a specific surface between 30 and 180 $m^2/g$. According to one embodiment, the active phase consists of cobalt and molybdenum. According to another embodiment, the active phase consists of cobalt, molybdenum and phosphorus.

Description of the finishing hydrodesulfurization stage (stage b) During the hydrodesulfurization stage a), a large part of the sulfur compounds is converted into $H_2S$. The remaining sulfur compounds are essentially refractory sulfur compounds and the recombinant mercaptans resulting from the addition of $H_2S$ formed in stage a) to the monoolefins present in the feedstock.

The "finishing" hydrodesulfurization stage b) is mainly carried out in order to decompose, at least in part, the recombinant mercaptans into olefins and into $H_2S$.

Stage b) also makes it possible to hydrodesulfurize the more refractory sulfur compounds.

Stage b) is carried out using a higher $H_2$/HC ratio and a higher temperature than those of stage a) and in the presence of a particular catalyst.

Stage b) consists in bringing at least a part of the effluent from stage a) into contact with hydrogen, in one or more hydrodesulfurization reactors, containing one or more catalysts suitable for carrying out the hydrodesulfurization.

The hydrodesulfurization stage b) is carried out without significant hydrogenation of the olefins. The degree of hydrogenation of the olefins of the catalyst of the hydrodesulfurization stage b) is generally less than 5% and more generally still less than 2%.

The temperature of this stage b) is generally between 280 and 400° C., more preferably between 300 and 380° C. and very preferably between 310 and 370° C. The temperature of this stage b) is generally greater by at least 5° C., preferably by at least 10° C. and very preferably by at least 30° C. than the temperature of stage a).

The operating pressure of this stage is generally between 0.5 and 5 MPa and preferably between 1 and 3 MPa.

The amount of catalyst employed in each reactor is generally such that the ratio of the flow rate of gasoline to be treated, expressed in $m^3$ per hour at standard conditions, per $m^3$ of catalyst (also called space velocity) is between 1 and 10 $h^{-1}$ and preferably between 2 and 8 $h^{-1}$.

The ratio of the hydrogen flow rate to the flow rate of feedstock to be treated, also called $H_2$/HC ratio, of stage b) is greater than the $H_2$/HC ratio of stage a). The ratio of the hydrogen flow rate to the flow rate of feedstock to be treated is understood to mean the ratio at the inlet of the reactor of the stage concerned. The $H_2$/HC ratios of each of stages a) and b) are associated via an adjustment factor defined as follows:

$$F=(H_2/HC_{\text{inlet of the reactor of stage b}})/(H_2/HC_{\text{inlet of the reactor of stage a}})$$

The adjustment factor F is greater than or equal to 1.05, preferably greater than 1.1 and in a preferred way between 1.1 and 6, preferably between 1.2 and 4 and preferentially between 1.2 and 2.

In order to produce such an $H_2$/HC ratio in stage b), a supply of hydrogen is necessary.

According to a preferred embodiment, fresh hydrogen is injected in stage b).

According to another embodiment, it is also possible to inject, in this stage b), recycled hydrogen, preferably freed beforehand from $H_2S$. The recycled hydrogen can originate from the separation stage c).

It is also possible to inject a mixture of fresh and recycled hydrogen.

A part of the hydrogen present in stage b) originates from stage a) (hydrogen not consumed by the reactions which take place in stage a)).

According to one embodiment, the amount of hydrogen injected solely in stage b) can be adjusted during the cycle, it being possible for the deactivation of the catalyst of the first stage a) to be compensated for by a gradual increase in the $H_2$/HC ratio in this reactor. This could, for example, be carried out by the use of a set of valves making it possible to dispense the hydrogen available by adjusting the hydrogen feed flow rates of the reactor(s) of stages a) and b).

According to another embodiment, when the $H_2$/HC ratio of stage b) is significantly higher than for stage a), stage b) can be carried out in a plurality of reactors in parallel in order to minimize the size of said reactors and the gas superficial velocity within said reactors.

The catalyst of stage b) is different in nature and/or in composition from that used in stage a). The catalyst of stage b) is in particular a very selective hydrodesulfurization catalyst: it makes it possible to hydrodesulfurize without hydrogenating the olefins and thus to maintain the octane number.

The catalyst which may be suitable for this stage b) of the process according to the invention, without this list being limiting, is a catalyst comprising an oxide support and an active phase consisting of at least one metal from group VIII and preferably chosen from the group formed by nickel, cobalt and iron. These metals can be used alone or in combination. Preferably, the active phase consists of a metal from group VIII, preferably nickel. Particularly preferably, the active phase consists of nickel.

The content of metal from group VIII is between 1% and 60% by weight of oxide of the metal from group VIII, with respect to the total weight of the catalyst, preferably of between 5% and 30% by weight, very preferably of between 5% and 20% by weight.

Preferably, the catalyst is characterized by a specific surface of between 5 and 400 $m^2/g$, preferably of between 10 and 250 $m^2/g$, preferably of between 20 and 200 $m^2/g$, very preferably of between 30 and 180 $m^2/g$. The specific surface is determined in the present invention by the BET method according to the standard ASTM D3663, as described in the work by Rouquerol F., Rouquerol J. and Singh K., *Adsorption by Powders & Porous Solids: Principle, Methodology and Applications*, Academic Press, 1999, for example by means of an Autopore III™ model device of the Micromeritics™ brand.

The pore volume of the catalyst is generally between 0.4 $cm^3/g$ and 1.3 $cm^3/g$, preferably between 0.6 $cm^3/g$ and 1.1 $cm^3/g$. The total pore volume is measured by mercury porosimetry according to the standard ASTM D4284 with a wetting angle of 140°, as described in the same work.

The tapped bulk density (TBD) of the catalyst is generally between 0.4 and 0.7 g/ml, preferably between 0.45 and 0.69 g/ml.

The TBD measurement consists in introducing the catalyst into a measuring cylinder, the volume of which has been determined beforehand, and then, by vibration, in tapping it until a constant volume is obtained. The bulk density of the tapped product is calculated by comparing the weight introduced and the volume occupied after tapping.

Advantageously, the catalyst of stage b), before sulfidation, exhibits a mean pore diameter of greater than 20 nm, preferably of greater than 25 nm, indeed even 30 nm and often of between 20 and 140 nm, preferably between 20 and 100 nm, and very preferentially between 25 and 80 nm. The pore diameter is measured by mercury porosimetry according to the standard ASTM D4284 with a wetting angle of 1400.

The catalyst can be in the form of cylindrical or multilobe (trilobe, quadrilobe, and the like) extrudates with a small diameter, or of spheres.

The oxide support of the catalyst is usually a porous solid chosen from the group consisting of: aluminas, silica, silica-aluminas and also titanium or magnesium oxides, used alone or as a mixture with alumina or silica-alumina. It is preferably chosen from the group consisting of silica, the family of the transition aluminas and silica-aluminas; very preferably, the oxide support is constituted essentially of alumina, that is to say that it comprises at least 51% by weight, preferably at least 60% by weight, very preferably at least 80% by weight, indeed even at least 90% by weight, of alumina. It preferably consists solely of alumina. Preferably, the oxide support of the catalyst is a "high temperature" alumina, that is to say which contains theta-, delta-, kappa- or alpha-phase aluminas, alone or as a mixture, and an amount of less than 20% of gamma-, chi- or eta-phase alumina.

A very preferred embodiment of the invention corresponds to the use, for stage b), of a catalyst consisting of alumina and of nickel, said catalyst containing a content by weight, with respect to the total weight of catalyst, of nickel oxide, in NiO form, of between 5% and 20%, said catalyst having a specific surface between 30 and 180 $m^2/g$.

The catalyst of the hydrodesulfurization stage b) is characterized by a hydrodesulfurization catalytic activity generally of between 1% and 90%, preferentially of between 1% and 70% and very preferably of between 1% and 50% of the catalytic activity of the catalyst of the hydrodesulfurization stage a).

The degree of removal of the mercaptans of stage b) is generally greater than 50% and preferably greater than 70%, so that the product resulting from stage b) contains less than 10 ppm sulfur and preferably less than 5 ppm sulfur resulting from the recombinant mercaptans, with respect to the total weight of the feedstock.

The degree of hydrogenation of the olefins of the catalyst of the hydrodesulfurization stage b) is generally less than 5% and more generally still less than 2%.

According to one embodiment, the hydrodesulfurization stages a) and b) can be carried out in at least two different reactors. When stages a) and b) are carried out using two reactors, the latter two are placed in series, the second reactor treating all the effluent at the outlet of the first reactor (without separation of the liquid and of the gas between the first and the second reactor) and while adding a hydrogen flow between the two reactors so that the $H_2$/HC ratio at the inlet of stage b) is greater than the $H_2$/HC ratio at the inlet of stage a).

According to another embodiment, the finishing stage b) can be carried out in at least two reactors placed in parallel at the outlet of stage a), without separation of the liquid and of the gas at the outlet of said stage a) and with an addition of hydrogen to each of the reactors of stage b). Preferably, stage b) is carried out with two reactors. In this case, a hydrogen flow is added to each of the reactors so as to have a $H_2$/HC ratio at the inlet of stage b) which is greater than the $H_2$/HC ratio at the inlet of stage a) as defined with the adjustment factor F. The reactors of stage b) can be equal or different in volume. The hydrogen at the inlet of the finishing stage b) consists, on the one hand, of hydrogen not consumed by the reactions which take place in the hydrodesulfurization stage a) and, on the other hand, of an addition of hydrogen (fresh and/or recycled, preferably freed from $H_2S$).

According to one embodiment, the addition of hydrogen is preferably carried out at the outlet of stage a) but upstream of the separation of the feed to the reactors in parallel of stage b). The $H_2$/HC ratio at the inlet of stage b) is thus the same for each reactor in parallel of stage b).

According to another embodiment, the $H_2$/HC ratio at the inlet of stage b) is different for each reactor in parallel of stage b) but greater than the $H_2$/HC ratio of stage a).

The operating conditions according to this embodiment are the operating conditions described for stage b) with a single reactor. The temperature of the reactors in parallel of stage b) may or may not be identical. Preferably, the temperature of the reactors of stage b) is identical in the two reactors in parallel, which makes it possible to use a single oven to heat the effluent from stage a).

According to yet another embodiment, a finishing stage b') can be carried out in parallel of stage b), stage b) being carried out with an addition of hydrogen and stage b') being carried out without addition of hydrogen, the two stages b) and b') being carried out at greater temperatures than that of stage a). The amount of hydrogen entering this stage b') then being subject and equal to the amount injected in stage a) decreased by the hydrogen consumed in stage a). A part of the effluent from stage a) is thus subjected to stage b) carried out with a high $H_2$/HC ratio (by injecting hydrogen) while the other part of the effluent from stage a) is subjected in parallel to a stage b') without injection of additional hydrogen. According to a preferred embodiment, all of the effluent from stage a) is sent into stages b) and b') (without separation of the liquid and of the gas between stage a) and stages b) and b') carried out in parallel).

More particularly, stage b') is carried out by bringing a part of the effluent resulting from stage a) without removal of the $H_2S$ formed, hydrogen and a hydrodesulfurization catalyst comprising an oxide support and an active phase consisting of at least one metal from group VIII into contact in at least one reactor at a temperature of between 280 and 400° C., at a pressure of between 0.5 and 5 MPa, with a space velocity of between 1 and 10 $h^{-1}$ and a ratio of the hydrogen flow rate, expressed in standard $m^3$ per hour, to the flow rate of feedstock to be treated, expressed in $m^3$ per hour at standard conditions, of between 100 and 600 $Sm^3/m^3$, said temperature of stage b') being higher than the temperature of stage a).

The temperature of this stage b') is generally between 280 and 400° C., more preferably between 300 and 380° C. and very preferably between 310 and 370° C. The temperature of this stage b') is generally greater by at least 5° C., preferably by at least 10° C. and very preferably by at least 30° C. than the mean operating temperature of stage a).

The temperature of stage b') may or may not be identical to the temperature of stage b).

The operating pressure of this stage b') is generally between 0.5 and 5 MPa and preferably between 1 and 3 MPa.

The amount of catalyst employed in each reactor is generally such that the ratio of the flow rate of gasoline to be treated, expressed in $m^3$ per hour at standard conditions, per $m^3$ of catalyst (also called space velocity) is between 1 and 10 $h^{-1}$ and preferably between 2 and 8 $h^{-1}$.

The hydrogen flow rate is subject and equal to the amount injected in stage a) decreased by the hydrogen consumed in stage a). The hydrogen flow rate is generally such that the ratio of the hydrogen flow rate, expressed in standard $m^3$ per hour ($Sm^3/h$), to the flow rate of feedstock to be treated, expressed in $m^3$ per hour at standard conditions (15° C., 0.1 MPa), is between 100 and 600 $Sm^3/m^3$, preferably between 200 and 500 $Sm^3/m^3$.

According to this embodiment, the part of the effluent from stage a) sent to stage b) represents between 10% and 90% by volume, preferably between 20% and 80% by volume, of the effluent from stage a).

The part of the effluent from stage a) sent to stage b') corresponds to the effluent from stage a) minus the effluent sent to stage b).

Preferably, the part of the effluent from stage a) sent to stage b) is greater than the part of the effluent from stage a) sent to stage b').

The catalyst of stage b') is a catalyst such as the catalyst described for the hydrodesulfurization stage b). The catalyst of stage b') can be identical to or different from the catalyst of stage b).

A very preferred embodiment of the invention corresponds to the use, for stage b'), of a catalyst consisting of alumina and of nickel, said catalyst containing a content by weight, with respect to the total weight of catalyst, of nickel oxide, in NiO form, of between 5% and 20%, said catalyst having a specific surface between 30 and 180 $m^2/g$.

Description of the Stage of Separation of the $H_2S$ (Stage c)

In accordance with the invention, in stage c) of the process, a stage of separation of the $H_2S$ formed and present in the effluent resulting from stage b) is carried out.

This stage is carried out in order to separate the excess hydrogen and also the $H_2S$ formed during stages a) and b). Any method known to a person skilled in the art can be envisaged.

According to a first embodiment, the effluent from stage b) is cooled to a temperature generally of less than 80° C. and preferably of less than 60° C. in order to condense the hydrocarbons. The gas and liquid phases are subsequently separated in a separation drum. The liquid fraction, which contains the desulfurized gasoline and also a fraction of the $H_2S$ dissolved, is sent to a stabilization column or debutanizer. This column separates a top cut, consisting essentially of residual $H_2S$ and of hydrocarbon compounds having a boiling point less than or equal to that of butane, and a bottom cut freed from $H_2S$, called stabilized gasoline, containing the compounds having a boiling point greater than that of butane.

According to a second embodiment, after the condensation stage, the liquid fraction resulting from the effluent from stage b) and which contains the desulfurized gasoline and also a fraction of the $H_2S$ dissolved is sent to a stripping section, while the gaseous fraction, consisting mainly of hydrogen and of $H_2S$, is sent to a purification section. The stripping can be carried out by heating the hydrocarbon fraction, alone or with an injection of hydrogen or steam, in a distillation column in order to extract, at the top, the light compounds which were entrained by dissolution in the liquid fraction and also the residual dissolved $H_2S$. The temperature of the stripped gasoline recovered at the column bottom is generally between 120° C. and 250° C.

Preferably, the separation stage c) is carried out in a stabilization column or debutanizer. This is because a stabilization column makes it possible to separate the $H_2S$ more efficiently than a stripping section.

When a stage b') is carried out in parallel of stage b), the $H_2S$ formed and present in the effluent resulting from stage b') is separated in the same way.

According to one embodiment, the effluent from stage b') is introduced, after cooling, as a mixture or not, into the same separation drum as the effluent from stage b) and then into the same stabilization column or into the same stripping section.

According to another embodiment, which is particularly preferred, the effluent from stage b') is introduced, after cooling, into a separation drum, the effluent from stage b) is introduced into another separation drum and then the liquid fractions resulting therefrom are introduced into the same stabilization column or into the same stripping section.

When a stage b) is carried out in several reactors in parallel, the $H_2S$ formed and present in the effluent resulting from each reactor of stage b) is separated in the same way.

According to one embodiment, each effluent from the reactors of stage b) is introduced, after cooling, as a mixture or not, into the same separation drum and then into the same stabilization column or into the same stripping section.

According to another embodiment, which is particularly preferred, each effluent from stage b) is introduced, after cooling, into a dedicated separation drum and then the liquid fractions resulting therefrom are introduced into the same stabilization column or into the same stripping section.

Stage c) is preferably carried out in order for the sulfur in the form of $H_2S$ remaining in the effluent from stage b) to represent less than 30%, preferably less than 20% and more preferably less than 10% of the total sulfur present in the treated hydrocarbon fraction.

It should be noted that the hydrodesulfurization stage b) or b') respectively and stage c) of separation of the $H_2S$, when the hydrodesulfurization and the separation are carried out in parallel, without using the same separation means, can be carried out simultaneously by means of a catalytic column equipped with at least one catalytic bed containing the hydrodesulfurization catalyst. Preferably, the catalytic distillation column comprises two beds of hydrodesulfurization catalyst and the effluent from stage b) or b') is sent into the column between the two beds of catalyst.

Description of the Preparation of the Catalysts and of the Sulfidation

The preparation of the catalysts of stages a), b) or b') is known and generally comprises a stage of impregnation of the metals from group VIII and from group VIb, when it is present, and optionally of phosphorus and/or of the organic compound on the oxide support, followed by a drying operation and then by an optional calcination making it possible to obtain the active phase in their oxide forms. Before its use in a process for the hydrodesulfurization of a sulfur-containing olefinic gasoline cut, the catalysts are generally subjected to a sulfidation in order to form the active entity as described below.

The impregnation stage can be carried out either by slurry impregnation, or by impregnation in excess, or by dry impregnation, or by any other means known to a person skilled in the art. The impregnation solution is chosen so as to be able to dissolve the metal precursors in the desired concentrations.

Use may be made, by way of example, among the sources of molybdenum, of the oxides and hydroxides, molybdic acids and their salts, in particular the ammonium salts, such as ammonium molybdate, ammonium heptamolybdate, phosphomolybdic acid ($H_3PMo_{12}O_{40}$), and their salts, and optionally silicomolybdic acid ($H_4SiMo_{12}O_{40}$) and its salts. The sources of molybdenum can also be any heteropolycompound of Keggin, lacunary Keggin, substituted Keggin, Dawson, Anderson or Strandberg type, for example. Use is preferably made of molybdenum trioxide and the heteropolycompounds of Keggin, lacunary Keggin, substituted Keggin and Strandberg type.

The tungsten precursors which can be used are also well known to a person skilled in the art. For example, use may be made, among the sources of tungsten, of the oxides and hydroxides, tungstic acids and their salts, in particular the ammonium salts, such as ammonium tungstate, ammonium metatungstate, phosphotungstic acid and their salts, and optionally silicotungstic acid ($H_4SiW_{12}O_{40}$) and its salts. The sources of tungsten can also be any heteropolycompound of Keggin, lacunary Keggin, substituted Keggin or Dawson type, for example. Use is preferably made of the oxides and the ammonium salts, such as ammonium metatungstate, or the heteropolyanions of Keggin, lacunary Keggin or substituted Keggin type.

The cobalt precursors which can be used are advantageously chosen from the oxides, hydroxides, hydroxycarbonates, carbonates and nitrates, for example. Use is preferably made of cobalt hydroxide and cobalt carbonate.

The nickel precursors which can be used are advantageously chosen from the oxides, hydroxides, hydroxycarbonates, carbonates and nitrates, for example.

The preferred phosphorus precursor is orthophosphoric acid $H_3PO_4$, but its salts and esters, such as ammonium phosphates, are also suitable. The phosphorus can also be introduced at the same time as the element(s) from group VIb in the form of Keggin, lacunary Keggin, substituted Keggin or Strandberg-type heteropolyanions. After the impregnation stage, the catalyst is generally subjected to a drying stage at a temperature of less than 200° C., advantageously of between 50° C. and 180° C., preferably between 70° C. and 150° C., very preferably between 75° C. and 130° C. The drying stage is preferentially carried out under an inert atmosphere or under an oxygen-containing atmosphere. The drying stage can be carried out by any technique known to a person skilled in the art. It is advantageously carried out at atmospheric pressure or at reduced pressure. Preferably, this stage is carried out at atmospheric pressure. It is advantageously carried out in a traversed bed using hot air or any other hot gas. Preferably, when the drying is carried out in a fixed bed, the gas used is either air or an inert gas, such as argon or nitrogen. Very preferably, the drying is carried out in a traversed bed in the presence of nitrogen and/or of air. Preferably, the drying stage has a duration of between 5 minutes and 15 hours, preferably between 30 minutes and 12 hours.

According to an alternative form of the invention, the catalyst has not undergone calcination during its preparation, that is to say that the impregnated catalytic precursor has not been subjected to a stage of heat treatment at a temperature of greater than 200° C. under an inert atmosphere or under an oxygen-containing atmosphere, in the presence or absence of water.

According to another alternative form of the invention, which is preferred, the catalyst has undergone a calcination stage during its preparation, that is to say that the impregnated catalytic precursor has been subjected to a stage of heat treatment at a temperature of between 250° C. and 1000° C. and preferably between 200° C. and 750° C., for a period of time typically of between 15 minutes and 10 hours, under an inert atmosphere or under an oxygen-containing atmosphere, in the presence or absence of water.

Before bringing into contact with the feedstock to be treated in a process for the hydrodesulfurization of gasolines, the catalysts of the process according to the invention generally undergo a sulfidation stage. The sulfidation is preferably carried out in a sulforeducing medium, that is to say in the presence of $H_2S$ and of hydrogen, in order to transform the metal oxides into sulfides, such as, for example, $MoS_2$, $Co_9S_8$ or $Ni_3S_2$. The sulfidation is carried out by injecting, onto the catalyst, a stream containing $H_2S$ and hydrogen, or else a sulfur compound capable of decomposing to give $H_2S$ in the presence of the catalyst and of hydrogen. Polysulfides, such as dimethyl disulfide (DMDS), are $H_2S$ precursors commonly used to sulfide catalysts. The sulfur can also originate from the feedstock. The temperature is adjusted in order for the $H_2S$ to react with the metal oxides to form metal sulfides. This sulfidation can be carried out in situ or ex situ (inside or outside the reactor) of the reactor of the process according to the invention at temperatures of between 200 and 600° C. and more preferentially between 300 and 500° C.

The degree of sulfidation of the metals constituting the catalysts is at least equal to 60%, preferably at least equal to 80%. The sulfur content in the sulfided catalyst is measured by elemental analysis according to ASTM D5373. A metal is regarded as sulfided when the overall degree of sulfidation, defined by the molar ratio of the sulfur (S) present on the catalyst to said metal, is at least equal to 60% of the theoretical molar ratio corresponding to the complete sulfidation of the metal(s) under consideration. The overall degree of sulfidation is defined by the following equation:

$$(S/\text{metal})_{catalyst} \geq 0.6 \times (S/\text{metal})_{theoretical}$$

in which:

$(S/\text{metal})_{catalyst}$ is the molar ratio of sulfur (S) to the metal present on the catalyst $(S/\text{metal})_{theoretical}$ is the molar ratio of sulfur to the metal corresponding to the complete sulfidation of the metal to give sulfide.

This theoretical molar ratio varies according to the metal under consideration:

$(S/Fe)_{theoretical}=1$ $(S/CO)_{theoretical}=8/9$ $(S/Ni)_{theoretical}=2/3$ $(S/MO)_{theoretical}=2/1$ $(S/W)_{theoretical}=2/1$ When the catalyst comprises several metals, the molar ratio of S present on the catalyst to the combined metals also has to be at least equal to 60% of the theoretical molar ratio corresponding to the complete sulfidation of each metal to give sulfide, the calculation being carried out in proportion to the relative molar fractions of each metal.

For example, for a catalyst comprising molybdenum and nickel with a respective molar fraction of 0.7 and 0.3, the minimum molar ratio (S/Mo+Ni) is given by the relationship:

$$(S/Mo+Ni)_{catalyst}=0.6\times\{(0.7\times 2)+(0.3\times(2/3))$$

Schemes which can be Employed within the Scope of the Invention

Different schemes can be employed in order to produce, at a lower cost, a desulfurized gasoline having a reduced content of mercaptans. The choice of the optimum scheme depends in fact on the characteristics of the gasolines to be treated and to be produced and also on the constraints specific to each refinery.

The schemes described below are given by way of illustration without limitation.

According to a first alternative form, a stage of distillation of the gasoline to be treated is carried out in order to separate two cuts (or fractions), namely a light cut and a heavy cut, and the heavy cut is treated according to the process of the invention. Thus, according to a first embodiment, the heavy cut is treated by the process according to the invention. This first alternative form has the advantage of not hydrotreating the light cut, which is rich in olefins and generally low in sulfur, which makes it possible to limit the loss of octane by hydrogenation of the olefins contained in the light cut. In the context of this first alternative form, the light cut has a boiling point range of less than 100° C. and the heavy cut has a boiling point range of greater than 65° C.

According to a second alternative form, the gasoline to be treated is subjected, before the hydrodesulfurization process according to the invention, to a preliminary stage consisting of a selective hydrogenation of the diolefins present in the feedstock, as described in the patent application EP 1 077 247.

The gasoline to be treated is treated beforehand in the presence of hydrogen and of a selective hydrogenation catalyst so as to at least partially hydrogenate the diolefins and to carry out a reaction for increasing the molecular weight of a part of the light mercaptan (RSH) compounds present in the feedstock to give thioethers, by reaction with olefins.

To this end, the gasoline to be treated is sent to a selective hydrogenation catalytic reactor containing at least one fixed or moving bed of catalyst for the selective hydrogenation of the diolefins and for increasing the molecular weight of the light mercaptans. The reaction for the selective hydrogenation of the diolefins and for increasing the molecular weight of the light mercaptans is preferentially carried out on a sulfided catalyst comprising at least one element from group VIII and optionally at least one element from group VIb and an oxide support. The element from group VIII is preferably chosen from nickel and cobalt and in particular nickel. The element from group VIb, when it is present, is preferably chosen from molybdenum and tungsten and very preferably molybdenum.

The oxide support of the catalyst is preferably chosen from alumina, nickel aluminate, silica, silicon carbide or a mixture of these oxides. Use is preferably made of alumina and more preferably still of high-purity alumina. According to a preferred embodiment, the selective hydrogenation catalyst contains nickel at a content by weight of nickel oxide, in NiO form, of between 1% and 12%, and molybdenum at a content by weight of molybdenum oxide, in $MoO_3$ form, of between 1% and 18% and a nickel/molybdenum molar ratio of between 0.3 and 2.5, the metals being deposited on a support consisting of alumina. The degree of sulfidation of the metals constituting the catalyst is preferably greater than 60%.

During the optional selective hydrogenation stage, the gasoline is brought into contact with the catalyst at a temperature of between 50 and 250° C., preferably between 80 and 220° C. and more preferably still between 90 and 200° C., with a liquid space velocity (LHSV) of between 0.5 $h^{-1}$ and 20 $h^{-1}$, the unit of the liquid space velocity being the liter of feedstock per liter of catalyst and per hour (l/l/h). The pressure is between 0.4 and 5 MPa, preferably between 0.6 and 4 MPa and more preferably still between 1 and 3 MPa. The optional selective hydrogenation stage is typically carried out with a ratio of the hydrogen flow rate, expressed in standard $m^3$ per hour, to the flow rate of feedstock to be treated, expressed in $m^3$ per hour at standard conditions, of between 2 and 100 $Sm^3/m^3$, preferably between 3 and 30 $Sm^3/m^3$.

After selective hydrogenation, the content of diolefins, determined via the maleic anhydride value (MAV), according to the UOP 326 method, is generally reduced to less than 6 mg maleic anhydride/g, indeed even less than 4 mg MA/g and more preferably less than 2 mg MA/g. In some cases, there may be obtained less than 1 mg MA/g.

The selectively hydrogenated gasoline is subsequently distilled into at least two cuts, a light cut and a heavy cut and optionally an intermediate cut. In the case of the fractionation into two cuts, the heavy cut is treated according to the process of the invention. In the case of the fractionation into three cuts, the intermediate and heavy cuts can be treated separately by the process according to the invention.

It should be noted that it is possible to envisage carrying out the stages of hydrogenation of the diolefins and of fractionation in two or three cuts simultaneously by means of a catalytic distillation column which includes a distillation column equipped with at least one catalytic bed.

Other characteristics and advantages of the invention will now become apparent on reading the description which will follow, given solely by way of illustration and without limitation, and with reference to the appended figures. In the figures, similar elements are generally designated by identical reference signs.

With reference to FIG. 1, the gasoline to be treated is sent via the line 1 and hydrogen is sent via the line 3 to a hydrodesulfurization unit 2 of stage a). The gasoline treated is generally a cracked gasoline, preferably a catalytic cracked gasoline. The gasoline is characterized by a boiling point typically extending between 30° C. and 220° C. The hydrodesulfurization unit 2 of stage a) is, for example, a reactor containing a supported hydrodesulfurization catalyst based on a metal from group VIII and VIb in a fixed bed or in a fluidized bed; preferably, a fixed bed reactor is used. The reactor is operated under operating conditions and in the presence of a hydrodesulfurization catalyst as described above to decompose the sulfur compounds and to form hydrogen sulfide ($H_2S$). During the hydrodesulfurization in stage a), recombinant mercaptans are formed by addition of $H_2S$ formed to the olefins. The effluent from the hydrodesulfurization unit 2 is subsequently introduced into the hydrodesulfurization unit 5 of stage b) via the line 4 without removal of the $H_2S$ formed. The hydrodesulfurization unit 5 is, for example, a reactor containing a hydrodesulfurization catalyst in a fixed bed or in a fluidized bed; preferably, a fixed bed reactor is used. The unit 5 is operated at a higher temperature than the unit 2 and in the presence of a particular catalyst comprising an oxide support and an active phase consisting of at least one metal from group VIII. The unit 5 is operated with a higher $H_2$/HC ratio than that of stage a) to at least partially decompose the recombinant mercaptans into olefins and into $H_2S$ by reduction of the $ppH_2S$. For this, hydrogen is supplied via the line 6. It also makes it possible to hydrodesulfurize, at least in part, the most refractory sulfur compounds. An effluent (gasoline) containing $H_2S$ is withdrawn from said hydrodesulfurization reactor 5 via the line 7. The effluent subsequently undergoes a stage of removal of the $H_2S$ (stage c) which consists, in the embodiment of FIG. 1, in treating the effluent by condensation by introducing the effluent from stage b) via the line 7 into a separation drum 8 in order to withdraw a gas phase containing $H_2S$ and hydrogen via the line 9 and a liquid fraction. The liquid fraction, which contains the desulfurized gasoline and also a fraction of the $H_2S$ dissolved, is sent via the line 10 to a stabilization column or debutanizer 11 in order to separate, at the top of the column via the line 12, a stream containing $C4^-$ hydrocarbons and the residual $H_2S$ and, at the bottom of the column via the line 13, a "stabilized" gasoline containing the compounds having a greater boiling point than that of butane.

Figure 2:
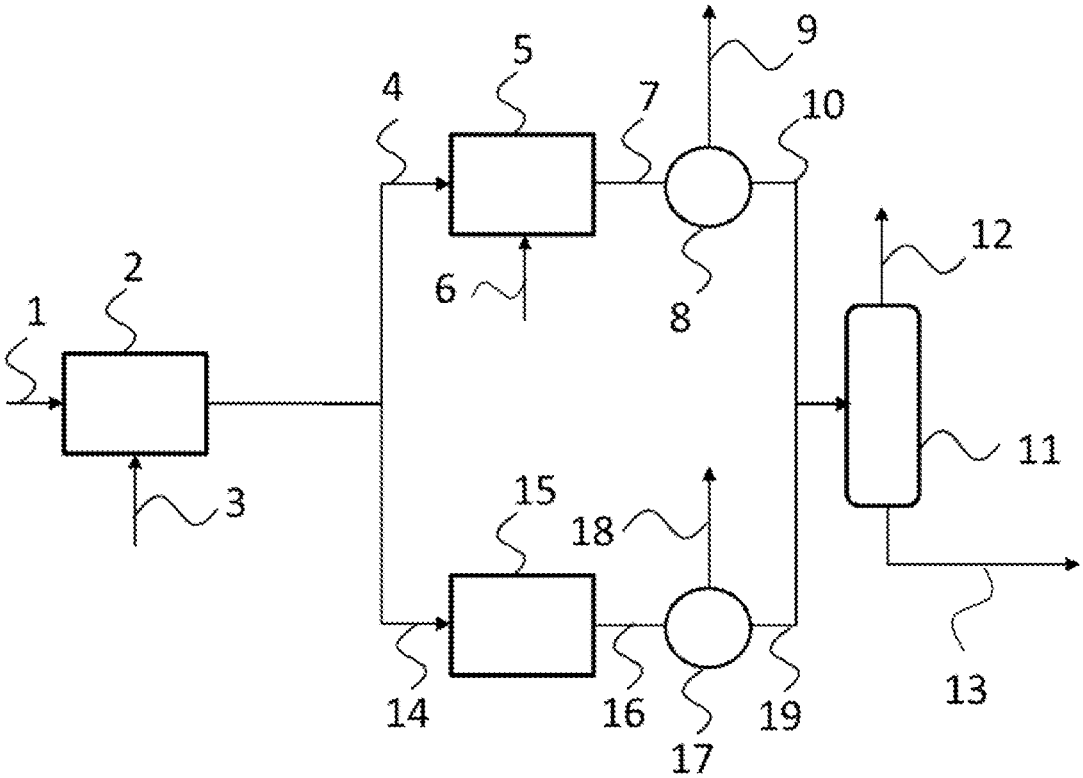
FIG. 2 illustrates another embodiment according to the invention.

FIG. 2 represents a second embodiment based on that of FIG. 1 and which differs by the presence of a finishing stage b') without injection of hydrogen in parallel of stage b). Just as in FIG. 1, the gasoline to be treated is sent via the line 1 and hydrogen is sent via the line 3 to a hydrodesulfurization unit 2 of stage a). A part of the effluent from the hydrodesulfurization unit 2 is then treated as described in FIG. 1.

Another part of the effluent from the hydrodesulfurization unit 2 is introduced into the hydrodesulfurization unit 15 of stage b') via the line 14 without removal of the $H_2S$ formed. The hydrodesulfurization unit 15 is, for example, a reactor containing a hydrodesulfurization catalyst in a fixed bed or in a fluidized bed; preferably, a fixed bed reactor is used. The unit 15 is operated at a higher temperature than the unit 2 and in the presence of a particular catalyst comprising an oxide support and an active phase consisting of at least one metal from group VIII. No hydrogen is supplied to the unit 15. An effluent (gasoline) containing $H_2S$ is withdrawn from said hydrodesulfurization reactor 15 via the line 16. The effluent subsequently undergoes a stage of removal of the $H_2S$ (stage d) which consists, in the embodiment of FIG. 2, in treating the effluent by condensation by introducing the effluent from stage b') via the line 16 into a separation drum 17 in order to withdraw a gas phase containing $H_2S$ and hydrogen via the line 18 and a liquid fraction. The liquid fraction, which contains the desulfurized gasoline and also a fraction of the $H_2S$ dissolved, is sent via the line 19 to the stabilization column or debutanizer 11 in order to separate, at the top of the column via the line 12, a stream containing $C4^-$ hydrocarbons and the residual $H_2S$ and, at the bottom of the column via the line 13, a "stabilized" gasoline containing the compounds having a greater boiling point than that of butane.

Figure 3:
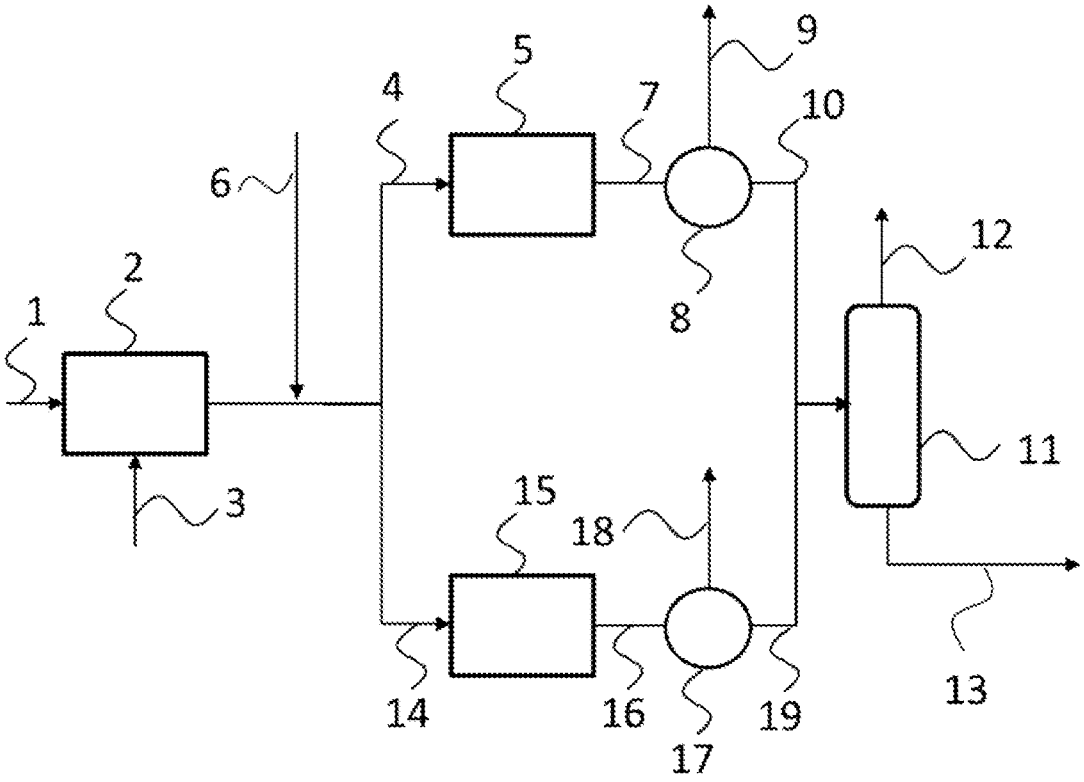
FIG. 3 illustrates another embodiment according to the invention.

FIG. 3 represents a third embodiment based on that of FIG. 2 and which differs by the addition of hydrogen. The addition of hydrogen (6) is carried out at the outlet of stage a) but upstream of the separation of the feed to the reactors in parallel of stage b). The $H_2$/HC ratio at the inlet of stage b) is thus the same for each reactor in parallel of stage b).

EXAMPLES

The examples below illustrate the invention.

The characteristics of the feedstock (catalytic cracked gasolines) treated by the process according to the invention are presented in table 1. The feedstock is a heavy FCC gasoline. The analytical methods used to characterize the feedstocks and effluents are as follows:

- gas chromatography (GC) for the hydrocarbon constituents and simulated distillation curve (% w/w)
- NF M 07052 method for the total elemental sulfur content in the gasoline
- ASTM D3227 method for the mercaptans by potentiometry
- NF EN 25164/M 07026-2/ISO 5164/ASTM D 2699 method for the research octane number
- NF EN 25163/M 07026-1/ISO 5163/ASTM D 2700 method for the motor octane number.

TABLE 1

Characteristics of the feedstock used

| | Feedstock |
|---|---|
| Density | 0.79 |
| Point 5% w/w distilled (° C.) | 61° C. |
| Point 95% w/w distilled (° C.) | 225° C. |
| Content of olefins (% weight) | 20 |
| Total S (ppm) | 1011 |
| Mercaptans by potentiometry (ppm S) | 4 |
| RON | 90 |
| MON | 80 |
| (RON + MON)/2 | 85 |

Example 1 (Comparative): Hydrodesulfurization of the Gasoline Over a Catalyst Making Possible the Desulfurization Stage a) According to the Invention The gasoline feedstock is treated by a desulfurization stage a) according to the invention. The desulfurization stage a) was carried out with 50 ml of CoMo/alumina catalyst, which are placed in an isothermal tubular reactor, having a fixed bed of catalyst. The catalyst is first of all sulfided by treatment for 4 hours under a pressure of 2 MPa at 350° C., in contact with a feedstock consisting of 2% by weight of sulfur in the form of dimethyl disulfide in n-heptane.

The hydrodesulfurization operating conditions are as follows: HSV=4 $h^{-1}$, $H_2$/HC=360, expressed in liter of hydrogen at standard conditions per liter of feedstock at standard conditions, P=2 MPa and a temperature of 250° C. Under these conditions, the effluent after desulfurization has the characteristics described in table 2.

TABLE 2

Comparison of the characteristics of the feedstock and of the desulfurized gasoline according to stage a) of the invention

| | Feedstock | Desulfurized gasoline |
|---|---|---|
| Density | 0.79 | 0.79 |
| Total S (ppm) | 1011 | 32 |
| Mercaptans (ppm S) | 4 | 21 |
| Olefins (% by weight) | 20% | 18% |
| RON | 90 | 87 |
| MON | 80 | 79 |
| (RON + MON)/2 | 85 | 83 |
| Loss in octane hydrodesulfurization stage a) | | 2 |
| % HDS* hydrodesulfurization stage a) | | 97% |
| % HDO** hydrodesulfurization stage a) | | 16% |

*% HDS denotes the degree of hydrodesulfurization

**% HDO denotes the degree of hydrogenation of the olefins

As indicated in table 2, the desulfurized effluent contains more compounds of mercaptans type than the feedstock because the mercaptans are produced by the recombination reactions between the olefins present in the feedstock and the $H_2S$ produced by the hydrodesulfurization reactions.

Example 2 (Comparative): Hydrodesulfurization of the Total Effluent Resulting from Example 1 with a Finishing Hydrodesulfurization Catalyst The total effluent resulting from the desulfurization stage a) of example 1 is subjected to a finishing hydrodesulfurization. The total effluent resulting from stage a) consists of:

the desulfurized gasoline (characteristics listed in table 2), hydrogen not consumed by the hydrodesulfurization and hydrogenation reactions which take place in stage a), and $H_2S$ produced during the desulfurization reactions of stage a).

The total effluent resulting from stage a) is subjected to a finishing hydrodesulfurization over a nickel-based catalyst, in an isothermal tubular reactor, having a fixed bed of catalyst. The finishing catalyst is prepared from a transition alumina of 140 $m^2/g$ provided in the form of beads 2 mm in diameter. The pore volume is 1 ml/g of support. 1 kilogram of support is impregnated with 1 liter of nickel nitrate solution. The catalyst is subsequently dried at 120° C. and calcined under a stream of air at 400° C. for one hour. The nickel content of the catalyst is 20% by weight. The catalyst (100 ml) is subsequently sulfided by treatment for 4 hours under a pressure of 2 MPa at 350° C., in contact with a feedstock containing 2% by weight of sulfur in the form of dimethyl disulfide in n-heptane.

The total effluent resulting from the hydrodesulfurization stage a) of example 1 is subjected to a finishing hydrodesulfurization under the following conditions: HSV=4 $h^{-1}$, P=2 MPa, a $H_2$/HC ratio=352, expressed in liters of hydrogen at standard conditions per liter of feedstock at standard conditions. The finishing hydrodesulfurization $H_2$/HC ratio is undergone because no addition of hydrogen is made between the hydrodesulfurization stage a) and the finishing hydrodesulfurization stage.

The temperature of the test is 380° C. At the outlet of the finishing reactor, the effluent is cooled and the condensed gasoline obtained after cooling is subjected to a hydrogen stripping stage in order to free the gasoline from the dissolved $H_2S$. The characteristics of the gasoline obtained after stripping are presented in table 3.

TABLE 3

Characteristics of the gasoline before and after finishing hydrodesulfurization over a nickel catalyst

| | Gasoline feedstock from before finishing HDS | Gasoline obtained after finishing HDS at 380° C. |
|---|---|---|
| Total S (ppm) | 32 | 14 |
| Mercaptans (ppm S) | 21 | 7 |
| Olefins (% by weight) | 18% | 18% |
| RON | 87 | 87 |
| MON | 79 | 79 |
| (RON + MON)/2 | 83 | 83 |
| Loss in octane finishing stage | / | 0 |
| % HDS finishing stage | / | 56% |
| % HDO finishing stage | / | 1% |
| % HDS mercaptans finishing stage | / | 67% |

The gasoline treated with a finishing hydrodesulfurization of example 2 contains 7 ppm S in the form of mercaptans, which corresponds to a degree of desulfurization of mercaptans of 67%. The gasoline obtained has 14 ppm of total sulfur, which corresponds to a degree of desulfurization of the finishing stage of 56%. Very advantageously, the nickel-based catalyst makes it possible to desulfurize the gasoline and to reduce its content of mercaptans without significantly hydrogenating the olefins of the gasoline. The degree of hydrogenation of the olefins is negligible; this makes it possible to avoid a loss of octane in this stage.

Example 3 (According to the Invention): Hydrodesulfurization of the Total Effluent Resulting from Example 1 with a Finishing Hydrodesulfurization Catalyst and with Addition of Hydrogen The total effluent resulting from the desulfurization stage a) of example 1 is subjected to a finishing hydrodesulfurization with a supplementary addition of hydrogen according to one embodiment of stage b) of the invention.

The total effluent resulting from stage a) consists of:

the desulfurized gasoline (characteristics listed in table 2), hydrogen not consumed by the hydrodesulfurization and hydrogenation reactions which take place in stage a), and $H_2S$ produced during the desulfurization reactions of stage a).

The total effluent resulting from stage a) is subjected to a finishing hydrodesulfurization with a supplementary addition of hydrogen over a nickel-based catalyst. The nickel-based finishing catalyst is prepared in the same way as that used in example 2. The catalyst is subjected to a sulfidation procedure identical to that described in example 2.

The total effluent resulting from the hydrodesulfurization stage a) of example 1 is subjected to a finishing hydrodesulfurization with a supplementary addition of hydrogen under the following conditions: HSV=4 $h^{-1}$, P=2 MPa. The addition of supplementary hydrogen to that which originates from the total effluent from stage a) is then carried out so as to have a $H_2$/HC ratio at the inlet of the finishing hydrodesulfurization reactor of 697, expressed in liters of hydrogen at standard conditions per liter of feedstock at standard conditions.

According to the invention, in order to carry out stage b), the adjustment factor $F=(H_2/HC_{inlet\ of\ the\ reactor\ of\ stage\ b})$ ratio)/($H_2/HC_{inlet\ of\ the\ reactor\ of\ stage\ a}$) ratio) is 1.94. The temperature of the test is 320° C. At the outlet of the finishing reactor, the effluent is cooled and the condensed gasoline obtained after cooling is subjected to a hydrogen stripping stage in order to free the gasoline from the dissolved $H_2S$. The characteristics of the gasoline obtained after stripping are presented in table 4.

TABLE 4

Characteristics of the gasoline after finishing hydrodesulfurization (stage b) according to the invention) over a nickel catalyst

| | Gasoline feedstock from before finishing HDS | Gasoline obtained after finishing HDS at 320° C. according to the invention |
|---|---|---|
| Total S (ppm) | 32 | 14 |
| Mercaptans (ppm S) | 21 | 8 |
| Olefins (% by weight) | 18% | 18% |
| RON | 87 | 87 |
| MON | 79 | 79 |
| (RON + MON)/2 | 83 | 83 |
| Loss in octane finishing stage b) | / | 0 |
| % HDS finishing stage | / | 56% |
| % HDO | / | 0% |
| % HDS mercaptans finishing stage b) | / | 62% |

The gasoline treated with a finishing hydrodesulfurization (stage b) according to the invention) carried out at 320° C.

and a $H_2$/HC ratio=697, expressed in liters of hydrogen at standard conditions per liter of feedstock at standard conditions at the inlet of stage b), makes it possible to obtain a desulfurized gasoline which has 14 ppm of total sulfur. This gasoline has 8 ppm S in the form of mercaptans, which corresponds to a degree of desulfurization of mercaptans of 62%. The nickel-based catalyst makes it possible to desulfurize the gasoline and to reduce its content of mercaptans without significantly hydrogenating the olefins of the gasoline. The degree of hydrogenation of the olefins is negligible; this makes it possible to avoid a loss of octane in this stage.

Comparatively, the two gasolines obtained by a finishing hydrodesulfurization treatment (example 2 and example 3) have the same content of total sulfur: 14 ppm weight. The content of mercaptans of these gasolines is also very similar (7 and 8 ppm S in the form of mercaptans, respectively). The two gasolines thus have very similar characteristics, given that their contents of total sulfur, of sulfur in the form of mercaptans and also the content of olefins are all very similar.

The finishing hydrodesulfurization stage according to the invention (example 3) has the advantage of employing a reaction temperature for the finishing hydrodesulfurization which is much less severe (320° C.) than a conventional finishing hydrodesulfurization (T=380° C.) without adjustment factor F (example 2). A difference of 60° C. in the temperature of the finishing reactor is observed in order to produce a desulfurized gasoline of the same quality. This is possible by virtue of the application of an adjustment factor $F=(H_2/HC_{inlet\ of\ the\ reactor\ of\ stage\ b})$ ratio)/($H_2$/$HC_{inlet\ of\ the\ reactor\ of\ stage\ a}$) ratio) of 1.94.

Compared to a finishing hydrodesulfurization without applying an adjustment factor F, the employment of a lower temperature in the finishing hydrodesulfurization stage is very advantageous because it makes it possible:

- to limit the cracking reactions of the gasoline at high temperature and the premature coking of the catalyst,
- to prolong the lifetime (also known as cycle time) of the catalyst.

Moreover, neither does the increase in the $H_2$/HC ratio at the inlet of stage b) according to the invention have an effect on the loss of octane of the gasoline because the olefins at the inlet of the finishing reactor b) are not hydrogenated with the nickel-based catalyst, even with a $H_2$/HC ratio 1.94 times greater than the base case. Consequently, the increase in the $H_2$/HC ratio at the inlet of stage b) according to the invention does not bring about a deterioration in the octane of the gasoline or overconsumption of hydrogen of the process.

The invention claimed is:

1. A process for the treatment of a gasoline containing sulfur compounds, olefins and diolefins, the process comprising at least the following stages:

a) the gasoline, hydrogen and a hydrodesulfurization catalyst comprising an oxide support and an active phase comprising a metal from group VIb and a metal from group VIII are brought into contact in at least one reactor at a temperature of between 210 and 320° C., at a pressure of between 1 and 4 MPa, with a space velocity of between 1 and 10 $h^{-1}$ and a ratio of the hydrogen flow rate, expressed in standard $m^3$ per hour, to the flow rate of feedstock to be treated, expressed in $m^3$ per hour at standard conditions, of between 100 $Sm^3/m^3$ and 600 $Sm^3/m^3$, so as to convert at least a part of the sulfur compounds into $H_2S$, b) at least a part of the effluent resulting from stage a) without removal of the $H_2S$ formed, hydrogen and a hydrodesulfurization catalyst comprising an oxide support and an active phase consisting of at least one metal from group VIII are brought into contact in at least one reactor at a temperature of between 280 and 400° C., at a pressure of between 0.5 and 5 MPa, with a space velocity of between 1 and 10 $h^{-1}$ and a ratio of the hydrogen flow rate to the flow rate of feedstock to be treated which is greater than that of stage a), said temperature of stage b) being higher than the temperature of stage a), and c) a stage of separation of the $H_2S$ formed and present in the effluent resulting from stage b) is carried out.

2. The process as claimed in claim 1, in which the ratio of the hydrogen flow rate to the flow rate of feedstock to be treated at the inlet of the reactor of stage b)/ratio of the hydrogen flow rate to the flow rate of feedstock to be treated at the inlet of the reactor of stage a) ratio is greater than or equal to 1.05.

3. The process as claimed in claim 2, in which the ratio of the hydrogen flow rate to the flow rate of feedstock to be treated at the inlet of the reactor of stage b)/ratio of the hydrogen flow rate to the flow rate of feedstock to be treated at the inlet of the reactor of stage a) ratio is between 1.1 and 6.

4. The process as claimed in claim 2, in which the ratio of the hydrogen flow rate to the flow rate of feedstock to be treated at the inlet of the reactor of stage b)/ratio of the hydrogen flow rate to the flow rate of feedstock to be treated at the inlet of the reactor of stage a) ratio is between 1.1 and 4.

5. The process as claimed in claim 2, in which the ratio of the hydrogen flow rate to the flow rate of feedstock to be treated at the inlet of the reactor of stage b)/ratio of the hydrogen flow rate to the flow rate of feedstock to be treated at the inlet of the reactor of stage a) ratio is between 1.2 and 2.

6. The process as claimed in claim 1, in which fresh hydrogen is injected in stage c).

7. The process as claimed in claim 1, in which the temperature of stage b) is greater by at least 5° C. than the temperature of stage a).

8. The process as claimed in claim 1, in which the catalyst of stage a) comprises alumina and an active phase comprising cobalt, molybdenum and optionally phosphorus, said catalyst containing a content by weight, with respect to the total weight of catalyst, of cobalt oxide, in CoO form, of between 0.1% and 10%, a content by weight, with respect to the total weight of catalyst, of molybdenum oxide, in $MoO_3$ form, of between 1% and 20%, a cobalt/molybdenum molar ratio of between 0.1 and 0.8 and a content by weight, with respect to the total weight of catalyst, of phosphorus oxide in $P_2O_5$ form of between 0.3% and 10%, when phosphorus is present, said catalyst having a specific surface area between 30 and 180 $m^2/g$.

9. The process as claimed in claim 1, in which the catalyst of stage b) consists of alumina and of nickel, said catalyst containing a content by weight, with respect to the total weight of catalyst, of nickel oxide, in NiO form, of between 5% and 20%, said catalyst having a specific surface area between 30 and 180 $m^2/g$.

10. The process as claimed in claim 1, in which the stage of separation c) of the effluent from stage b) is carried out in a debutanizer or a stripping section.

11. The process as claimed in claim 1, in which, before stage a), a stage of distillation of the gasoline is carried out so as to fractionate said gasoline into at least a light gasoline cut and a heavy gasoline cuts, and the heavy gasoline cut is treated in stages a), b) and c).

12. The process as claimed in claim 1, in which, before stage a) and before any optional distillation stage, the gasoline is brought into contact with hydrogen and a selective hydrogenation catalyst in order to selectively hydrogenate the diolefins contained in said gasoline to give olefins.

13. The process as claimed in claim 1, in which the gasoline is a catalytic cracked gasoline.

14. The process as claimed in claim 1, in which stage b) is carried out in at least two reactors in parallel.

15. The process as claimed in claim 14, in which the ratio of the hydrogen flow rate to the flow rate of feedstock to be treated of stage b) is the same for each reactor in parallel.

16. The process as claimed in claim 1, in which, during a stage b') carried out in parallel of stage b), another part of the effluent resulting from stage a) without removal of the $H_2S$ formed, hydrogen and a hydrodesulfurization catalyst comprising an oxide support and an active phase consisting of at least one metal from group VIII are brought into contact in at least one reactor at a temperature of between 280 and 400° C., at a pressure of between 0.5 and 5 MPa, with a space velocity of between 1 and 10 $h^{-1}$ and a ratio of the hydrogen flow rate, expressed in standard $m^3$ per hour, to the flow rate of feedstock to be treated, expressed in $m^3$ per hour at standard conditions, of between 100 and 600 $Sm^3/m^3$, said temperature of stage b') being higher than the temperature of stage a).

17. The process as claimed in claim 16, in which stage b') carried out in parallel of stage b), is carried out without the addition of hydrogen.

18. The process as claimed in claim 16, wherein part of the effluent resulting from stage a) that is sent to stage b) is between 10% and 90% of the effluent resulting from stage a).

19. The process as claimed in claim 16, wherein part of the effluent resulting from stage a) that is sent to stage b) is between 20% and 80% of the effluent resulting from stage a).

20. The process as claimed in claim 16, wherein the part of the effluent resulting from stage a) that is sent to stage b) is greater than the part of the effluent resulting from stage a) that is sent to stage b').

21. The process as claimed in claim 16, the effluent from stage b') is also separated in the stage of separation c), and the stage of separation c) is carried out in a debutanizer or a stripping section.

* * * * *